US009828878B2

(12) United States Patent
Abbott et al.

(10) Patent No.: US 9,828,878 B2
(45) Date of Patent: Nov. 28, 2017

(54) METHOD AND APPARATUS FOR SUPPORTING AND ALIGNING DIAPHRAGMS IN TURBOMACHINES

(71) Applicant: DRESSER-RAND COMPANY, Olean, NY (US)

(72) Inventors: Nathan Abbott, Stamford (GB); Kevin John Lewis Roy, Clifton Park, NY (US); Jeffrey Robert Simkins, Albany, NY (US); Oral Ricardo Willis, Clifton Park, NY (US)

(73) Assignee: Dresser-Rand Company, Olean, NY (US)

( * ) Notice: Subject to any disclaimer, the term of this patent is extended or adjusted under 35 U.S.C. 154(b) by 926 days.

(21) Appl. No.: 13/905,718

(22) Filed: May 30, 2013

(65) Prior Publication Data

US 2013/0323026 A1 Dec. 5, 2013

Related U.S. Application Data

(60) Provisional application No. 61/653,120, filed on May 30, 2012.

(51) Int. Cl.

| | |
|---|---|
| ***F03D 5/00*** | (2006.01) |
| ***F01D 25/24*** | (2006.01) |
| *F01D 25/28* | (2006.01) |

(52) U.S. Cl.

CPC ..... *F01D 25/246* (2013.01); *F01D 25/28* (2013.01)

(58) Field of Classification Search

CPC ..... F01D 25/28; F01D 25/24; F01D 25/246; F01D 25/243; F01D 25/26; F01D 25/265; F01D 25/285

USPC ..... 415/209.2, 209.3, 209.4, 210.1, 213.1, 415/214.1

See application file for complete search history.

(56) References Cited

U.S. PATENT DOCUMENTS

| | | | | |
|---|---|---|---|---|
| 3,861,827 | A * | 1/1975 | Peabody | F01D 25/246 415/199.5 |
| 6,352,405 | B1 * | 3/2002 | Tomko | F01D 25/265 415/209.2 |
| 2003/0049123 | A1 * | 3/2003 | Nelligan | F01D 25/246 415/209.2 |
| 2011/0250063 | A1 * | 10/2011 | Burdgick | F01D 25/246 415/209.2 |
| 2012/0121391 | A1 * | 5/2012 | Burdgick | F01D 25/243 415/148 |

* cited by examiner

*Primary Examiner* — Craig Kim
*Assistant Examiner* — Jason Mikus

(57) ABSTRACT

A clamping and support system for a turbine is disclosed. The clamping and support system may include a support bar coupled with a lower diaphragm portion of the turbine. The support bar may have a protuberance extending from a first end portion thereof that may at least partially extend into a slot formed in the lower diaphragm portion of the turbine. The clamping and support system may also include a clamping bar coupled with a second end portion of the support bar. The clamping bar may at least partially extend into a slot formed in an upper diaphragm portion of the turbine such that at least a portion of the lower diaphragm portion and at least a portion of the upper diaphragm portion are interposed between the clamping bar and the protuberance of the support bar, thereby coupling the lower diaphragm portion with the upper diaphragm portion.

4 Claims, 5 Drawing Sheets

METHOD AND APPARATUS FOR SUPPORTING AND ALIGNING DIAPHRAGMS IN TURBOMACHINES

CROSS-REFERENCE TO RELATED APPLICATIONS

The present application claims priority to U.S. Provisional Patent Application Ser. No. 61/653,120, which was filed May 30, 2012. This priority application is hereby incorporated by reference in its entirety into the present application to the extent it is consistent with the present disclosure.

BACKGROUND

The present disclosure relates to turbomachines and more particularly to supporting and aligning a diaphragm within the turbomachine.

Turbomachines, and specifically turbines, transfer energy from a moving fluid to a rotary shaft by directing the moving fluid over a set of rotatable blades attached to the rotary shaft. In turbines having multiple sets of rotatable blades, one or more sets of stationary blades or vanes may be positioned between the multiple sets of rotatable blades to redirect the moving fluid from a first set of rotatable blades toward subsequent sets of rotatable blades. The sets of stationary blades may be supported by or integrally formed with outer supporting disks or diaphragms coupled to a casing of the turbines.

In order to facilitate installation, adjustment, and maintenance, the diaphragms may often be constructed from two portions separable along a midline thereof. During installation, the position of the diaphragms in the turbines may be adjusted such that the sets of stationary blades may be properly aligned to redirect the moving fluid to the subsequent sets of rotatable blades. Additionally, sealing features of the diaphragms may also be properly located relative to the rotary shaft to ensure proper operation of the turbines. Once the diaphragms are properly adjusted, the diaphragms may be coupled or secured to the casing of the turbines such that the sets of stationary blades remain aligned with the sets of rotatable blades during operation.

In operation, the performance and efficiency of the turbines may be determined, at least in part, by the alignment of the diaphragms coupled to the casing thereof. For example, misalignment of the diaphragms and the sets of stationary blades supported by or integrally formed therewith may not allow the sets of stationary blades to properly redirect the moving fluid to the subsequent sets of rotatable blades. An inability to properly redirect the moving fluid to the subsequent sets of rotatable blades may result in an inefficient transfer of energy from the moving fluid to the rotary shaft.

What is needed, then, is an improved turbomachine and method of assembly thereof, capable of properly aligning the diaphragms and the stationary blades coupled therewith within the casing of the turbomachine.

SUMMARY

Embodiments of the disclosure may provide a clamping and support system for a turbine. The clamping and support system may include a support bar coupled with a lower diaphragm portion of the turbine. The support bar may have a protuberance extending from a first end portion thereof that may at least partially extend into a slot formed in the lower diaphragm portion of the turbine. The clamping and support system may also include a clamping bar coupled with a second end portion of the support bar. The clamping bar may at least partially extend into a slot formed in an upper diaphragm portion of the turbine such that at least a portion of the lower diaphragm portion and at least a portion of the upper diaphragm portion are interposed between the clamping bar and the protuberance of the support bar, thereby coupling the lower diaphragm portion with the upper diaphragm portion.

Embodiments of the disclosure may further provide another clamping and support system for a turbine. The clamping and support system may include a support bar having a protuberance extending from a first end portion thereof. The protuberance may at least partially extend into a slot formed in a lower diaphragm portion of the turbine. A first attachment member may extend through the support bar to couple the support bar with the lower diaphragm portion of the turbine. The clamping and support system may further include a clamping bar disposed adjacent to a second end portion of the support bar. The clamping bar may at least partially extend into a slot formed in an upper diaphragm portion of the turbine such that at least a portion of the lower diaphragm portion and at least a portion of the upper diaphragm portion are interposed between the clamping bar and the protuberance of the support bar. A second attachment member may extend through the clamping bar to couple the clamping bar with the second end portion of the support bar, thereby coupling the lower diaphragm portion with the upper diaphragm portion.

Embodiments of the disclosure may further provide a turbine including a casing having an upper casing portion and a lower casing portion, and a lower diaphragm portion positioned in the lower casing portion. The turbine may also include a first lower alignment block and a second lower alignment block. Each lower alignment block may be coupled with and may extend radially outward from a perimeter of the lower diaphragm portion at an opposing radial end thereof from the other lower alignment block. Each lower alignment block may also be at least partially disposed in a respective receptacle formed in the lower casing portion of the turbine. A first adjustment member and a second adjustment member may movably extend through the first lower alignment block and the second lower alignment block, respectively. The first adjustment member and the second adjustment member may be configured to engage the respective receptacles formed in the lower casing portion. The first adjustment member and the second adjustment member may further be configured to at least partially control a position of the lower diaphragm portion relative to the lower casing portion.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
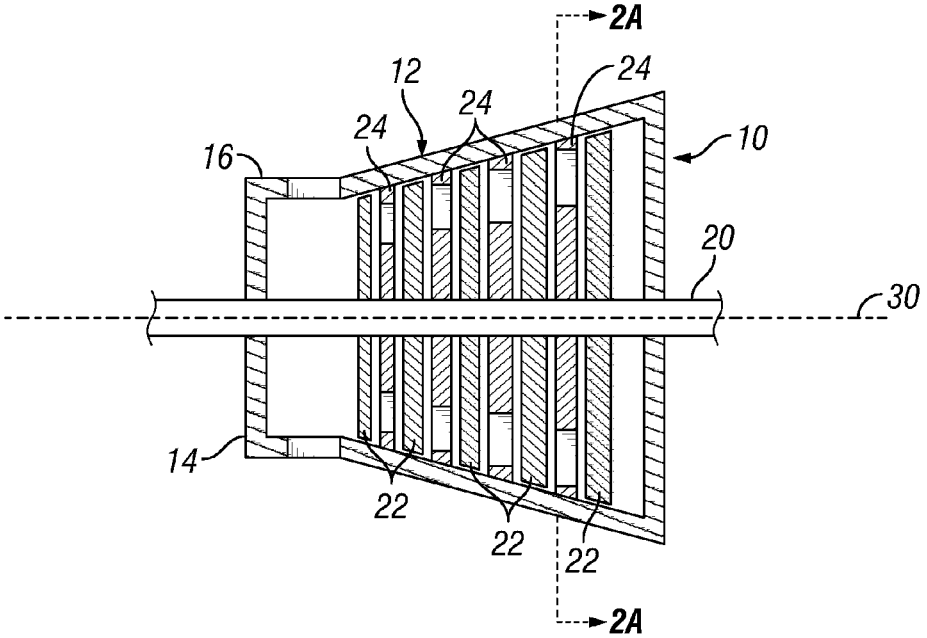
FIG. 1 illustrates a partial schematic side view of an exemplary turbomachine, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring now to the drawings in detail, wherein like numbers are used to indicate like elements throughout, FIG. 1 illustrates a partial schematic side view of an exemplary turbomachine 10, according to one or more embodiments. The turbomachine 10 may include a unitary outer casing 12 having a first, or lower, casing portion 14 and a second, or upper, casing portion 16. The lower casing portion 14 and the upper casing portion 16 may be coupled with one another along a midline 30 to form the outer casing 12. The turbomachine 10 may include a shaft 20 configured to support one or more sets of rotating blades 22 coupled therewith. The turbomachine 10 may include diaphragms 24 positioned between the respective sets of rotating blades 22 and coupled with the outer casing 12. In at least one embodiment, the diaphragms 24 may be fixedly secured to the outer casing 12. In another embodiment, the diaphragms 24 may be secured to the outer casing 12 in a manner that may allow limited movement of the diaphragms 24 relative to the outer casing 12.

Figure 2A:
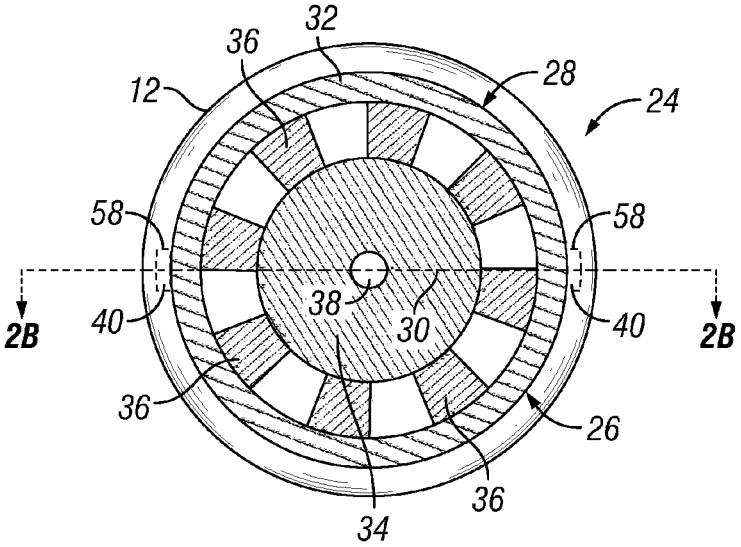
FIG. 2A illustrates a partial schematic end view of the turbomachine taken along line 2A-2A in FIG. 1, according to one or more embodiments disclosed.
Figure 2B:
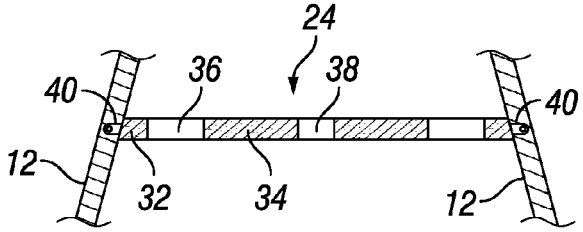
FIG. 2B illustrate a partial schematic cross-sectional view of the turbomachine taken along line 2B-2B in FIG. 2A, according to one or more embodiments disclosed.

FIGS. 2A and 2B illustrate partial schematic views of the exemplary diaphragm 24 of the turbomachine 10, according to one or more embodiments. Particularly, FIG. 2A illustrates a partial schematic end view of the turbomachine 10 taken along line 2A-2A in FIG. 1, according to one or more embodiments. Further, FIG. 2B illustrates a partial schematic cross-sectional view of the turbomachine 10 taken along line 2B-2B in FIG. 2A, according to one or more embodiments. As illustrated in FIG. 2A, the diaphragm 24 may include a first, or lower, diaphragm portion 26 and a second, or upper, diaphragm portion 28 that may be in contact with one another along the midline 30. Each of the lower and upper diaphragm portions 26, 28 may include an outer ring 32 and an inner ring 34 that may define a shaft opening 38 through which the shaft 20 may extend. The outer ring 32 and the inner ring 34 may be configured to support or position a plurality of vanes 36 interposed therebetween. The lower and upper diaphragm portions 26, 28 may include lower and upper alignment blocks 40, 58 coupled with the outer rings 32 thereof. As illustrated in FIG. 2A, the lower and upper alignment blocks 40, 58 may be positioned or disposed on opposing radial ends of the lower and upper diaphragm portions 26, 28. The lower and upper alignment blocks 40, 58 may also be positioned or disposed substantially adjacent to the midline 30. The lower and upper alignment blocks 40, 58 may extend radially outward from a perimeter or outer circumferential surface of the lower and upper diaphragm portions 26, 28. The lower and upper alignment blocks 40, 58 may provide a mechanism for supporting and aligning the diaphragm 24 within the outer casing 12 of the turbomachine 10, as further described herein.

As illustrated in FIG. 2A, the opposing radial ends of the lower diaphragm portion 26 be substantially similar with one another. Similarly, the opposing radial ends of the upper diaphragm portion 28 may also be substantially similar with one another. It may be appreciated that each of the opposing radial ends of the lower and upper diaphragm portions 26, 28 disclosed herein may include similar components and parts. Accordingly, discussions herein regarding one of the opposing radial ends of the lower diaphragm portion 26 and/or the upper diaphragm portion 28 are equally applicable to the other opposing radial ends thereof. Further, as illustrated in FIG. 2A, the lower diaphragm portion 26 may include two lower alignment blocks 40 coupled with and disposed on the opposing radial ends thereof and the upper diaphragm portion 28 may include two upper alignment blocks 58 coupled with and disposed on the opposing radial ends thereof. It may be appreciated that each of the lower alignment blocks 40 of the lower diaphragm portion 26 and each of the upper alignment blocks 58 of the upper diaphragm portion 28 disclosed herein may include similar components and parts. Accordingly, discussions herein regarding one of the lower alignment blocks 40 are equally applicable to the remaining lower alignment block 40. Similarly, discussions herein regarding one of the upper alignment blocks 58 are equally applicable to the remaining upper alignment block 58.

Figure 3A:
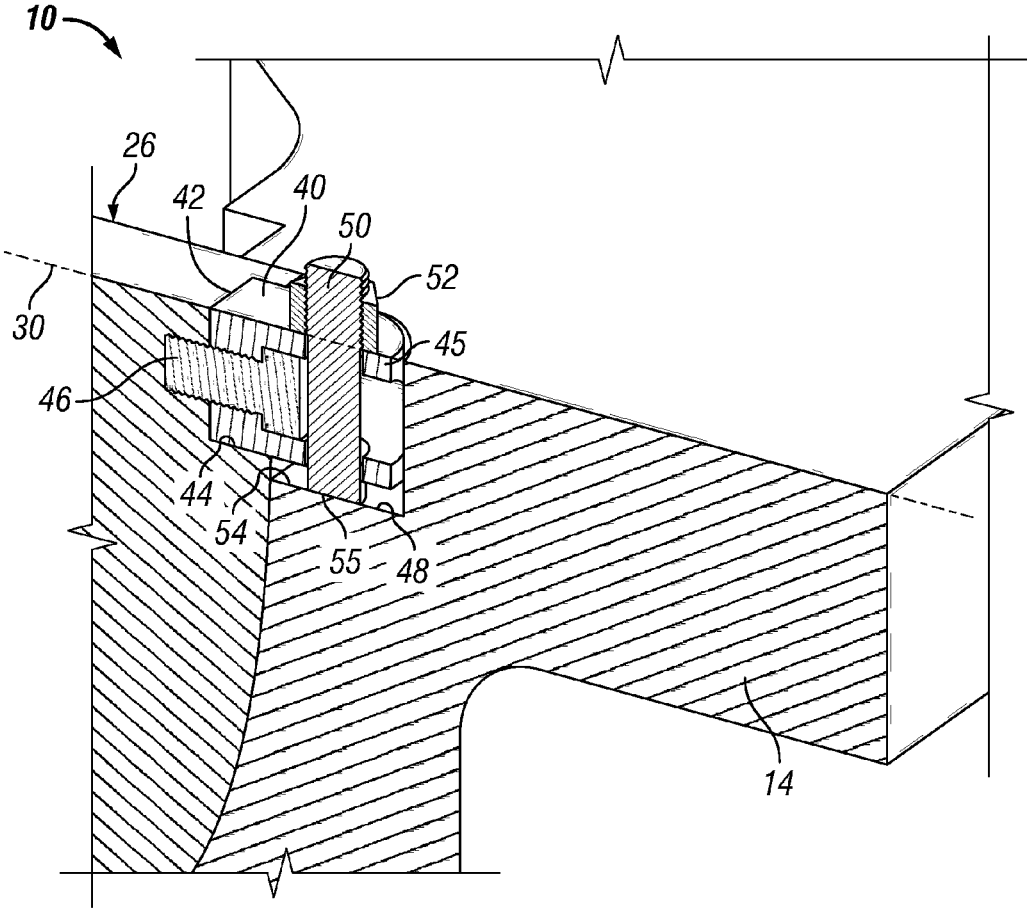
FIG. 3A illustrates a partial cross-sectional view of an exemplary lower diaphragm portion installed in an exemplary lower casing portion of the turbomachine, according to one or more embodiments disclosed.
Figure 3B:
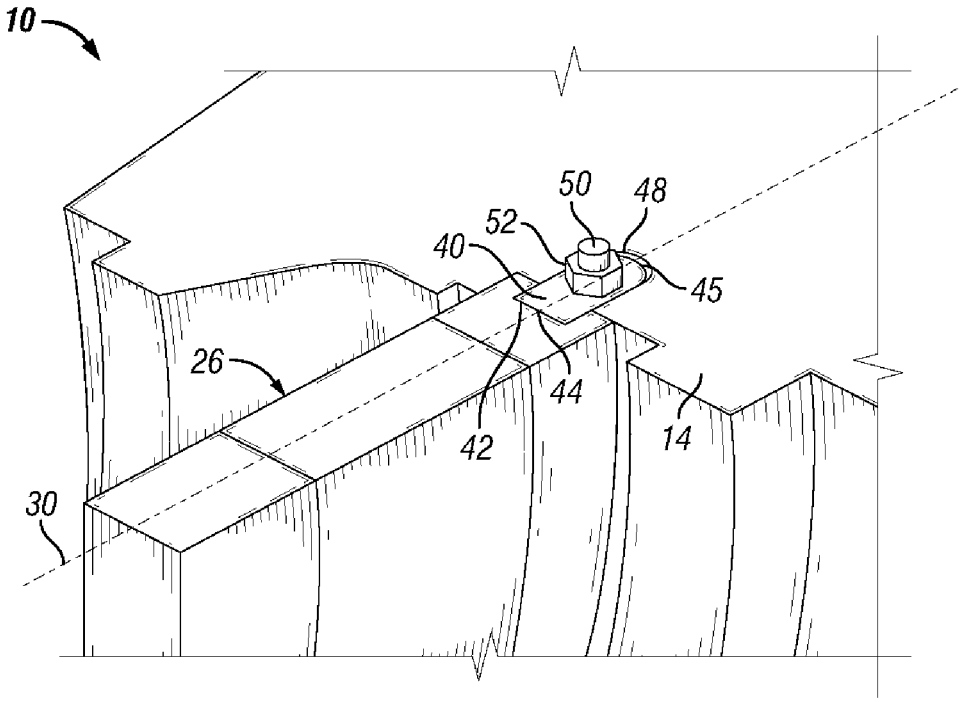
FIG. 3B illustrates a partial perspective view of the lower diaphragm portion installed in the lower casing portion of the turbomachine, according to one or more embodiments disclosed.

FIG. 3A illustrates a partial cross-sectional view of the lower diaphragm portion 26 installed in the lower casing portion 14 of the turbomachine 10, according to one or more embodiments. FIG. 3B illustrates a partial perspective view of the lower diaphragm portion 26 installed in the lower casing portion 14 of the turbomachine 10, according to one or more embodiments. In at least one embodiment, the lower alignment block 40 may be coupled directly to the perimeter of the lower diaphragm portion 26. The lower alignment block 40 may also be manufactured integral with the lower diaphragm portion 26 or may be coupled to the lower diaphragm portion 26 by welding, brazing, or via other mechanical fasteners, such as threaded bolts or screws. In at least one embodiment, the lower alignment block 40 may be at least partially disposed in a slot 44 formed in the perimeter of the lower diaphragm portion 26. The lower alignment block 40 may be shaped to closely fit or engage with the slot 44. For example, as illustrated in FIGS. 3A and 3B, the lower alignment block 40 may have a first end 42 that may be at least partially inserted into the slot 44 so as to align the lower alignment block 40 with the lower diaphragm portion 26 along the midline 30 of the turbomachine 10. Further, as illustrated in FIG. 3A, an attachment member 46, such as a bolt or screw, may be inserted through the lower alignment block 40 to couple the lower alignment block 40 to the lower diaphragm portion 26. In at least one embodiment, a second end 45 of the lower alignment block 40 may be at least partially disposed within a corresponding receptacle 48 formed in an interior surface of the lower casing portion 14.

As illustrated in FIG. 3A, an adjustment member 50 may extend through the lower alignment block 40 such that a first end 55 of the adjustment member 50 may engage or contact at least a portion of the receptacle 48. For example, the first end 55 of the adjustment member 50 may protrude or extend from the lower alignment block 40 and engage a base 54 of the receptacle 48. In at least one embodiment, at least a portion of the adjustment member 50 may extend from the lower alignment block 40 such that the portion may be interposed or located between the lower alignment block 40 and the base 54 of the receptacle 48. The portion of the adjustment member 50 interposed between the lower alignment block 40 and the base 54 of the receptacle 48 may define a vertical extension of the adjustment member 50 from the lower alignment block 40. As further described herein, the vertical extension of the adjustment member 50 may determine, at least in part, a position and/or orientation of the lower diaphragm portion 26 relative to the lower casing portion 14 of the turbomachine 10.

The adjustment member 50 may be any structure or device capable of engaging the lower alignment block 40 and allowing the vertical adjustment of the adjustment member 50 relative to the lower alignment block 40. In at least one embodiment, the adjustment member 50 may be a bolt or threaded stud that may engage corresponding threads of the lower alignment block 40. The adjustment member 50 may be vertically adjusted relative to the lower alignment block 40 by rotating the adjustment member 50 relative to the lower alignment block 40. The vertical adjustment of the adjustment member 50 may vary the portion of the adjustment member 50 interposed between the lower alignment block 40 and the base 54 of the receptacle 48, thereby varying the vertical extension of the adjustment member 50 from the lower alignment block 40.

A locking member 52 may be coupled to the adjustment member 50 to prevent movement of the adjustment member 50 when coupled therewith. For example, the locking member 52 may be a nut or other like device that may prevent rotation of the adjustment member 50 relative to the lower alignment block 40. In at least one embodiment, as illustrated in FIG. 3A, the adjustment member 50 may be positioned or located substantially adjacent to the attachment member 46 to thereby prevent the attachment member 46 from rotating and separating from the lower diaphragm portion 26 and/or the lower alignment block 40.

To install the lower diaphragm portion 26, the lower alignment blocks 40 may be disposed into the slots 44 located on the opposing radial ends of the lower diaphragm portion 26. As previously discussed, the lower alignment block 40 may be manufactured integral with the lower diaphragm portion 26 or may be coupled to the lower diaphragm portion 26 by welding, brazing, or via other mechanical fasteners, such as threaded bolts or screws. For example, the lower alignment blocks 40 may be coupled to the lower diaphragm portion 26 via the attachment members 46. The adjustment members 50 may be threaded into each of the lower alignment blocks 40 such that the first end 55 of the respective adjustment members 50 extends from the lower alignment blocks 40. The lower diaphragm portion 26 may then be disposed within the lower casing portion 14 such that the second end 45 of each of the lower alignment blocks 40 may be disposed within a respective receptacle 48, the receptacles 48 disposed on the opposing radial ends of the lower casing portion 14 and the first end 55 of each of the adjustment members 50 may engage or contact a respective base 54 of the receptacles 48.

Once the lower alignment blocks 40 are disposed within the receptacles 48, each of the adjustment members 50 may be vertically adjusted, such as by rotation, to vary the vertical extension of the adjustment members 50 from the lower alignment blocks 40, and thereby position the lower alignment blocks 40 within the receptacles 48. Adjusting the lower alignment blocks 40 within the receptacles 48 may adjust the position and/or orientation of the lower diaphragm portion 26 relative to the lower casing portion 14. For example, adjusting the adjustment members 50 at the opposing radial ends of the lower diaphragm portion 26 an equal amount or degree may adjust the position of the lower diaphragm portion 26 in a direction perpendicular to the midline 30, thereby adjusting an elevation, or vertical adjustment, of the lower diaphragm portion 26 relative to the lower casing portion 14. In another example, adjusting the adjustment members 50 at the opposing radial ends of the lower diaphragm portion 26 a differential amount or degree may vary a rotational orientation of the lower diaphragm portion 26 relative to the lower casing portion 14, thereby adjusting a side-to-side, or "rocking," alignment of the lower diaphragm portion 26 relative to the lower casing portion 14. Once the lower diaphragm portion 26 is properly positioned within the lower casing portion 14, the locking members 52 may be coupled with the adjustment members 50 to fix or secure the position and orientation of the lower diaphragm portion 26 relative to the lower casing portion 14.

Figure 4:
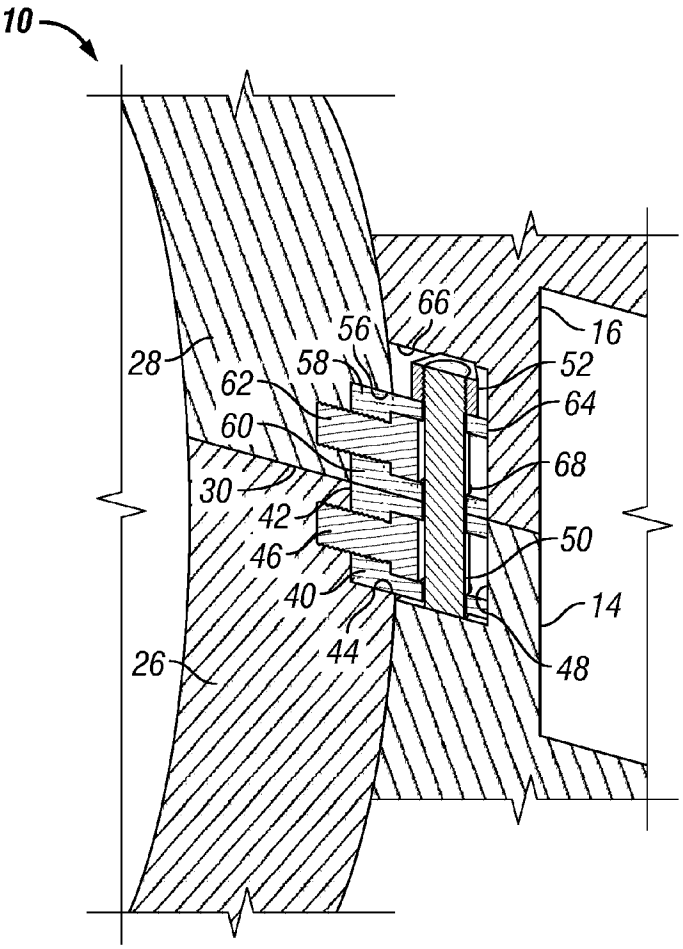
FIG. 4 illustrates a partial sectional view of the turbomachine having an exemplary upper diaphragm portion and an exemplary upper casing portion installed, according to one or more embodiments disclosed.

FIG. 4 illustrates a partial sectional view of the turbomachine 10 having the upper diaphragm portion 28 and the upper casing portion 16 installed, according to one or more embodiments. The upper diaphragm portion 28 may include the upper alignment block 58 coupled to and extending radially outward from the perimeter thereof. The upper alignment block 58 may be coupled to the upper diaphragm portion 28 such that when the lower and upper diaphragm portions 26, 28 are in an installed position, the upper alignment block 58 may be substantially aligned with the lower alignment block 40. In at least one embodiment, the upper alignment block 58 may engage or be in contact with the lower alignment block 40. In another embodiment, the upper alignment block 58 may be separated from the lower alignment block 40 by a gap or other component, such as a spacer or shim (not shown). The upper alignment block 58 may define a hole 68 extending therethrough that may allow the upper alignment block 58 to be coupled to the lower alignment block 40 via the adjustment member 50.

Similar to the lower diaphragm portion 26, the upper diaphragm portion 28 may have slots 56 configured to align the upper alignment block 58 with the upper diaphragm portion 28 along the midline 30 of the turbomachine 10. The slots 56 of the upper diaphragm portion 28 may be positioned substantially opposite the slots 44 of the lower diaphragm portion 26 such that the upper alignment blocks 58 and the lower alignment blocks 40 may be substantially aligned with one another when the lower and upper diaphragm portions 26, 28 are installed. The upper casing portion 16 may include receptacles 66 formed in an interior surface thereof. The receptacles 66 of the upper casing portion 16 may be positioned or located adjacent to the midline 30 and opposite the receptacles 48 formed in the lower casing portion 14.

The upper alignment block 58 may have a first end 60 at least partially disposed in the slot 56 on the upper diaphragm portion 28. The upper alignment block 58 may be manufactured integral with the upper diaphragm portion 28 or may be coupled to the upper diaphragm portion 28 by welding, brazing, or via other mechanical fasteners. For example, an attachment member 62, such as a bolt or screw, may be inserted through the upper alignment block 58 to couple the upper alignment block 58 to the upper diaphragm portion 28. A second end 64 of the upper alignment block 58 may be at least partially disposed within the corresponding receptacle 66 formed in the interior surface of the upper casing portion 16. The adjustment member 50 may extend through the hole 68 defined in the upper alignment block 58 to effectively aligning the upper diaphragm portion 28 with the lower diaphragm portion 26. The locking member 52 may engage the adjustment member 50 to secure and fix the position and orientation of the lower and upper diaphragm portions 26, 28.

During installation, the upper diaphragm portion 28 may be coupled to the lower diaphragm portion 26 after the lower diaphragm portion 26 has been installed and aligned and after the shaft 20 and rotating blades 22 are installed. The upper diaphragm portion 28 may be installed by removing the locking members 52 from the adjustment members 50, if coupled therewith, and then inserting the adjustment members 50 through the holes 68 of the upper alignment blocks 58. Once the upper diaphragm portion 28 is in place, the locking members 52 may be coupled with the adjustment members 50 to secure the upper alignment blocks 58 to the lower alignment blocks 40, and thereby secure or lock the lower and upper diaphragm portions 26, 28 together and in proper position within the outer casing 12.

In at least one embodiment, the lower and upper alignment blocks 40, 58 may be used to couple the lower and upper diaphragm portions 26, 28 together during manufacturing. The adjustment members 50 and the locking members 52 may be used to couple the lower and upper alignment blocks 40, 58 together such that the lower and upper diaphragm portions 26, 28 may be machined as a complete assembly. The embodiments disclosed herein may improve manufacturing processes and ensure that the lower and upper diaphragm portions 26, 28, and components thereof, may be aligned when installed in the outer casing 12 of the turbomachine 10.

Figure 5:
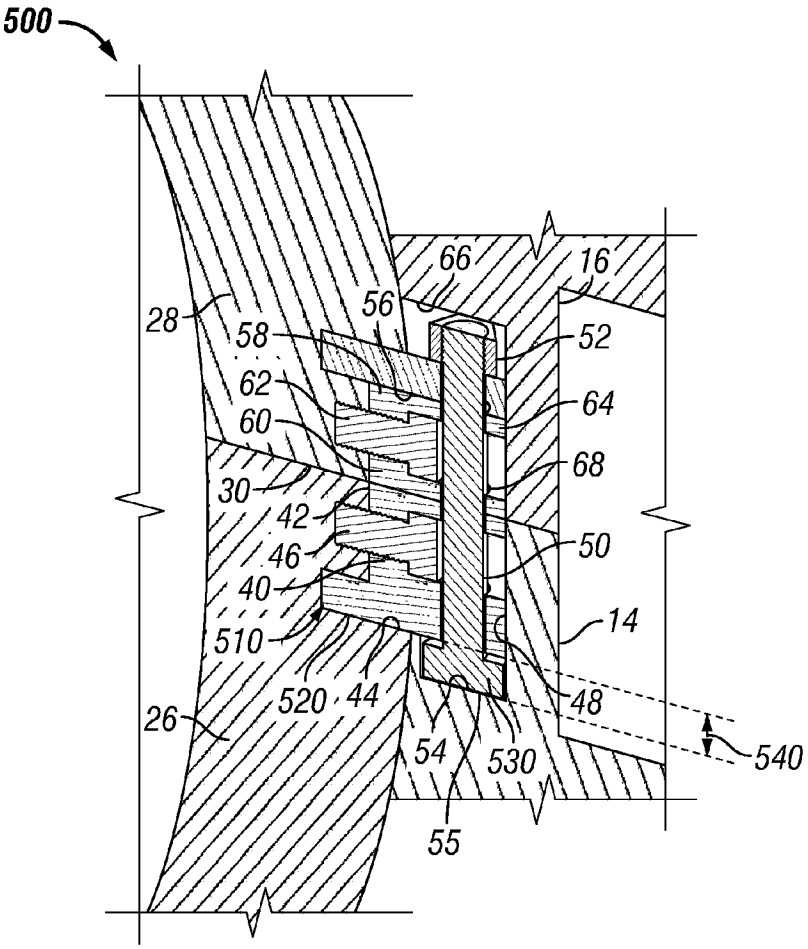
FIG. 5 illustrates a partial sectional view of another exemplary turbomachine, according to one or more embodiments disclosed.

FIG. 5 illustrates a partial sectional view of another exemplary turbomachine 500, according to one or more embodiments. The turbomachine 500 may be similar in some respects to the turbomachine 10 described above and therefore may be best understood with reference to the description of FIGS. 1-4 where like numerals designate like components and will not be described again in detail.

As illustrated in FIG. 5, the lower diaphragm portion 26 may include a groove 510 disposed adjacent to the slot 44 formed therein. The groove 510 may extend radially inward and may be configured to receive at least a portion of the lower alignment block 40. For example, the lower alignment block 40 may further include an extension 520 that may at least partially extend into the groove 510 defined in the lower diaphragm portion 26. In at least one embodiment, the slot 44 and the groove 510 may be shaped to closely fit or engage with the lower alignment block 40. For example, the groove 510 may be shaped such that at least a portion of the extension 520 of the lower alignment block 40 may be inserted therein, and the slot 44 may be shaped such that at least a portion of the first end 42 of the lower alignment block 40 may be inserted therein. In at least one embodiment, the slot 44 and the groove 510 may be shaped to engage with the lower alignment block 40 such that the lower alignment block 40 and the lower diaphragm portion 26 may be aligned with one another along the midline 30. In at least one embodiment, the attachment member 46 (e.g., bolt or screw) may be inserted through the lower alignment block 40 to couple the lower alignment block 40 to the lower diaphragm portion 26. In another embodiment, the lower alignment block 40 may be coupled to the lower diaphragm portion 26 by welding, brazing, shrink fitting, press fitting, or via other mechanical fasteners.

As illustrated in FIG. 5, the adjustment member 50 may extend through the lower alignment block 40 such that the first end 55 of the adjustment member 50 may engage or contact at least a portion of the receptacle 48. For example, the first end 55 of the adjustment member 50 may protrude or extend from the lower alignment block 40 and engage the base 54 of the receptacle 48 defined in the lower casing portion 14. As illustrated in FIG. 5, the first end 55 of the adjustment member 50 may include a base support 530 configured to engage the base 54 of the receptacle 48. In at least one embodiment, at least a portion of the adjustment member 50 may extend from the lower alignment block 40. The portion of the adjustment member 50 extending from the lower alignment block 40 or interposed between the lower alignment block 40 and the base 54 of the receptacle 48 may define the vertical extension 540 of the adjustment member 50. As previously discussed, the adjustment member 50 may be a bolt or threaded stud that may engage corresponding threads of the lower alignment block 40. Accordingly, the adjustment member 50 may be vertically adjusted relative to the lower alignment block 40 by rotating the adjustment member 50. The vertical adjustment of the adjustment member 50 may vary the vertical extension 540 and thereby adjust the position (e.g., elevation) and/or orientation (e.g., side-to-side alignment) of the lower diaphragm portion 26 relative to the lower casing portion 14.

Figure 6:
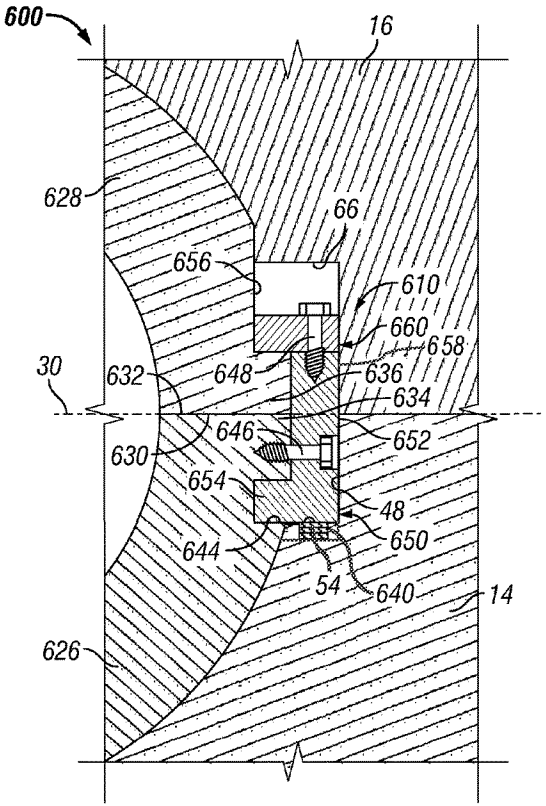
FIG. 6 illustrates a partial sectional view of another exemplary turbomachine having a lower diaphragm portion and an upper diaphragm portion supported by the lower casing portion via an exemplary clamping and support system, according to one or more embodiments disclosed.

FIG. 6 illustrates a partial sectional view of another exemplary turbomachine 600 having a lower diaphragm portion 626 and an upper diaphragm portion 628 coupled with one another and supported by the lower casing portion 14 via an exemplary clamping and support system 610, according to one or more embodiments. The turbomachine 600 may be similar in some respects to the turbomachines 10, 500 described above and therefore may be best understood with reference to the description of FIGS. 1-5 where like numerals designate like components and will not be described again in detail.

In at least one embodiment, the lower diaphragm portion 626 may be positioned within the lower casing portion 14 and the upper diaphragm portion 628 may be disposed adjacent or atop the lower diaphragm portion 626. The upper casing portion 16 may be disposed adjacent or atop the lower casing portion 14 to define the midline 30 at an interface therebetween. For example, the midline 30 may be at least partially defined by interfacing surfaces of the lower casing portion 14 and the upper casing portion 16.

As illustrated in FIG. 6, the lower diaphragm portion 626 and the upper diaphragm portion 628 may each include a pair of opposing, horizontal joint surfaces 630, 632, respectively (only one of each pair is shown). Additionally, as illustrated in FIG. 6, the lower diaphragm portion 626 and the upper diaphragm portion 628 may each include a pair of recesses or pockets 644, 656 formed in the perimeter thereof, respectively (only one of each pair is shown). The lower diaphragm portion 626 and the upper diaphragm portion 628 may also each include a pair of flanges 634, 636 (only one of each pair is shown) interposed between the recesses 644, 656 and the horizontal joint surfaces 630, 632, respectively. The flanges 634, 636 may be configured to facilitate the clamping or coupling of the lower diaphragm portion 626 and the upper diaphragm portion 628 with one another via the clamping and support system 610, as further described herein.

In at least one embodiment, the clamping and support system 610 may include a support bar 650 and a clamping bar 660. The support bar 650 may include a vertical body portion 652 having an inwardly projecting extension or protuberance 654 disposed at a lower end portion thereof. At least a portion of the protuberance 654 may extend into and engage at least a portion of the recess 644 formed in the perimeter of the lower diaphragm portion 626. The vertical body portion 652 of the support bar 650 may extend along at least a portion of the perimeter of the lower diaphragm portion 626 and the upper diaphragm portion 628 such that an upper end portion 658 of the support bar 650 may be positioned near or adjacent the recess 656 formed in the upper diaphragm portion 628. A first attachment member 646, such as a bolt or a screw, may extend through the support bar 650 to couple the support bar 650 with the lower diaphragm portion 626. For example, the first attachment member 646 may extend through the vertical body portion 652 of the support bar 650 at a location adjacent the protuberance 654 to couple the support bar 650 with the lower diaphragm portion 626.

As illustrated in FIG. 6, the clamping bar 660 may be or include a horizontal plate disposed adjacent to or atop of the support bar 650 and coupled therewith. In at least one embodiment, the clamping bar 660 may be disposed adjacent to or atop of the upper end portion 658 of the support bar 650, and a second attachment member 648, such as a bolt or a screw, may extend through the clamping bar 660 to couple the clamping bar 660 with the support bar 650. For example, the second attachment member 648 may extend through the clamping bar 660 and at least a portion of the upper end portion 658 of the support bar 650 to couple the clamping bar 660 and the support bar 650 with one another. In at least one embodiment, coupling the clamping bar 660 with the support bar 650 via the second attachment member 648 may correspondingly couple the lower diaphragm portion 626 with the upper diaphragm portion 628. For example, at least a portion of the clamping bar 660 may extend into the recess 656 of the upper diaphragm portion 628 such that the respective flanges 634, 636 of the lower and upper diaphragm portions 626, 628 may be interposed between the clamping bar 660 and the protuberance 654 of the support bar 650. Accordingly, fastening the second attachment member 648 to couple the clamping bar 660 with the support bar 650 may provide a clamping force or load to the flanges 634, 636 of the lower and upper diaphragm portions 626, 628 interposed therebetween, thereby coupling the lower and upper diaphragm portions 626, 628 with one another.

In at least one embodiment, at least a portion of the protuberance 654 of the support bar 650 may be supported on the base 54 of the receptacle 48 defined in the lower casing portion 14. Accordingly, it may be appreciated that the lower diaphragm portion 626 and the upper diaphragm portion 628 coupled therewith may be supported on the base 54 of the receptacle 48. In at least one embodiment, one or more shims 640 may be interposed between the protuberance 654 of the support bar 650 and the base 54 of the receptacle 48. The shims 640 may be provided to control an elevation of the support bar 650 and the lower diaphragm portion 626 coupled therewith. It may be appreciated that an equal number of shims 640 may be added or removed from each of the opposing radial ends of the turbomachine 600 to control the elevation, or vertical adjustment, of the lower diaphragm portion 626 relative to the lower casing portion 14. It may be further appreciated that a differential number of shims 640 may be added or removed from the support bar 650 on each of the opposing radial ends of the turbomachine 600 to control a side-to-side, or "rocking," alignment of the lower diaphragm portion 626 relative to the lower casing portion 14. In another embodiment, the elevation and/or the side-to-side alignment of the lower diaphragm portion 626 relative to the lower casing portion 14 may be controlled with set screws (not shown) that may extend through at least a portion of the support bars 650 and engage the base 54 of the receptacle 48 on each of the opposing radial ends of the turbomachine 600.

In operation, the lower diaphragm portion 626 may be installed in the lower casing portion 14 by coupling the support bars 650 with the lower diaphragm portion 626 at the opposing radial ends thereof via the first attachment member 646. The elevation and/or the side-to-side alignment of the lower diaphragm portion 626 may then be adjusted via the shims 640 or the set screws (not shown)

such that the lower diaphragm portion 626 may be aligned with the midline 30 of the turbomachine 600. The upper diaphragm portion 628 may then be coupled with the lower diaphragm portion 626 by coupling the clamping bar 660 with the support bar 650 via the second attachment member 648.

Figure 7:
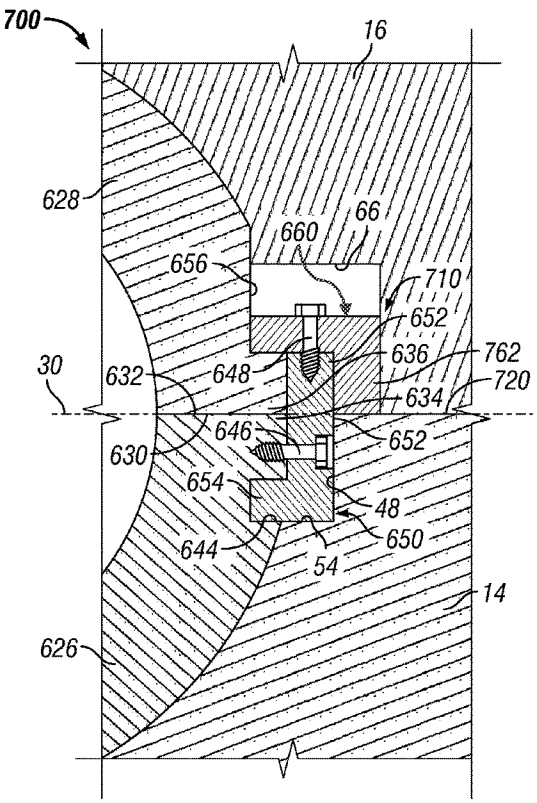
FIG. 7 illustrates a partial sectional view of another exemplary turbomachine having a lower diaphragm portion and the upper diaphragm portion supported by the lower casing portion via another exemplary clamping and support system, according to one or more embodiments disclosed.

FIG. 7 illustrates a partial sectional view of another exemplary turbomachine 700 having the lower diaphragm portion 626 and the upper diaphragm portion 628 coupled with one another and supported by the lower casing portion 14 via another exemplary clamping and support system 710, according to one or more embodiments. The turbomachine 700 may be similar in some respects to the turbomachine 600 described above and therefore may be best understood with reference to the description of FIG. 6 where like numerals designate like components and will not be described again in detail.

As illustrated in FIG. 7, the clamping bar 660 may further include a vertical body 762 that may extend along at least a portion of the vertical body portion 652 of the support bar 650 and engage a horizontal edge portion 720 of the lower casing portion 14 along the midline 30. At least a portion of the vertical body 762 of the clamping bar 660 may be supported on the horizontal edge portion 720 of the lower casing portion 14. In at least one embodiment, one or more shims (not shown) may be interposed between the vertical body 762 of the clamping bar 660 and the horizontal edge portion 720 of the lower casing portion 14. The shims may be provided to control the elevation of the clamping bar 660 and the support bar 650 coupled therewith via the second attachment member 648. Accordingly, the shims may be provided to control the elevation and/or the side-to-side alignment of the lower diaphragm portion 626 coupled with the support bar 650. For example, an equal number of shims may be added to or removed from each of the opposing radial ends of the turbomachine 700 to control the elevation, or vertical adjustment, of the lower diaphragm portion 626 relative to the lower casing portion 14. In another example, a differential number of shims may be added to or removed from each side of the turbomachine 700 to control the side-to-side alignment of the lower diaphragm portion 626 relative to the lower casing portion 14. In another embodiment, the elevation and/or the side-to-side alignment of the lower diaphragm portion 14 relative to the lower casing portion 14 may be controlled with set screws (not shown) that may extend through at least a portion of the vertical body 762 of the clamping bar 660 and engage the horizontal edge portion 720 of the lower casing portion 14.

In operation, the lower and upper diaphragm portions 626, 628 may be supported by the lower casing portion 14 by coupling the support bar 650 with the lower diaphragm portion 626 via the first attachment member 646. The upper diaphragm portion 628 may then be coupled with the lower diaphragm portion 626 by coupling the clamping bar 660 with the support bar 650 via the second attachment member 648. The vertical body 762 of the clamping bar 660 may engage the horizontal edge portion 720 of the lower casing portion 14 to thereby support the lower and upper diaphragm portions 626, 628 upon the lower casing portion 14. The elevation and/or the side-to-side alignment of the lower and upper diaphragm portions 626, 628 may then be adjusted via the shims (not shown) or the set screws (not shown). The lower and upper diaphragm portions 626, 628 may be adjusted such that the lower diaphragm portion 626 and the upper diaphragm portion 628 coupled therewith may be aligned with the midline 30 of the turbomachine 700. It may be appreciated that the lower diaphragm portion 626 and the upper diaphragm portion 628 coupled therewith may be at least partially supported on the horizontal edge portion 720 of the lower casing portion 14. It may be further appreciated that at least a portion of the lower and upper diaphragm portions 626, 628 may also be supported on the base 54 of the receptacle 48 formed in the lower casing portion 14.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

We claim:

1. A clamping and support system for a turbine, comprising:

a support bar coupled with a lower diaphragm portion of the turbine, the support bar having a protuberance extending from a first end portion thereof, the protuberance at least partially extending into a slot formed in the lower diaphragm portion of the turbine;

a clamping bar coupled with a second end portion of the support bar, the clamping bar at least partially extending into a slot formed in an upper diaphragm portion of the turbine such that at least a portion of the lower diaphragm portion and at least a portion of the upper diaphragm portion are interposed between the clamping bar and the protuberance of the support bar, thereby coupling the lower diaphragm portion with the upper diaphragm portion;

a first attachment member extending horizontally through the support bar and configured to couple the support bar with the lower diaphragm portion of the turbine; and a second attachment member extending vertically through the clamping bar and into the second end portion of the support bar, and configured to couple the clamping bar with the second end portion of the support bar.

2. The clamping and support system of claim 1, wherein the support bar at least partially extends into a receptacle formed in a lower casing portion of the turbine, the lower casing portion configured to at least partially support the support bar and the lower diaphragm portion coupled therewith.

3. The clamping and support system of claim 1, wherein the clamping bar further comprises a vertical body extending along at least a portion of the support bar, the vertical body of the clamping bar configured to engage a lower casing portion of the turbine.

4. The clamping and support system of claim 3, further comprising a shim interposed between the vertical body of the clamping bar and the lower casing portion of the turbine, the shim configured to control a position of the lower diaphragm portion relative to the lower casing portion.

* * * * *